US007493751B2

(12) United States Patent
Oda et al.

(10) Patent No.: US 7,493,751 B2
(45) Date of Patent: Feb. 24, 2009

(54) EXTERNAL COMBUSTION ENGINE

(75) Inventors: Shuzo Oda, Kariya (JP); Shinichi Yatsuzuka, Nagoya (JP); Katsuya Komaki, Kariya (JP); Shunji Okemoto, Tokai (JP); Toshiyuki Morishita, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/717,794

(22) Filed: Mar. 13, 2007

(65) Prior Publication Data

US 2007/0214784 A1 Sep. 20, 2007

(30) Foreign Application Priority Data

Mar. 17, 2006 (JP) ..... 2006-074351

(51) Int. Cl.
*F02C 5/00* (2006.01)

(52) U.S. Cl. ..... 60/39.6; 60/508; 60/670

(58) Field of Classification Search ..... 60/39.6, 60/508–515, 670

See application file for complete search history.

(56) References Cited

U.S. PATENT DOCUMENTS 6,931,852 B2 * 8/2005 Yatsuzuka et al. ..... 60/670
6,973,788 B2 * 12/2005 Oda et al. ..... 60/645
2005/0257524 A1 * 11/2005 Yatsuzuka et al. ..... 60/670

* cited by examiner

*Primary Examiner*—Hoang M Nguyen
(74) *Attorney, Agent, or Firm*—Harness, Dickey & Pierce, PLC

(57) ABSTRACT

An external combustion engine is disclosed, comprising a container (11) for sealing a working liquid (12) in a way adapted to allow the liquid to flow therein, a heater (13) for heating and vaporizing the working liquid (12) in the container (11), and a cooler (14) for cooling and liquefying the vapor of the working liquid (12) heated and vaporized by the heater (13). The displacement of the working liquid (12) caused by the volume change of the vapor of the working liquid (12) is output by being converted into mechanical energy. In the heated portion (11*d*) of the container (11) for vaporizing the working liquid (12), the direction of displacement of the working liquid (12) at the parts (17, 19) far from the cooler (14) is changed with respect to the direction of displacement at the part (16) near to the cooler (14).

23 Claims, 5 Drawing Sheets

EXTERNAL COMBUSTION ENGINE

BACKGROUND OF THE INVENTION

1. Field of the Invention

This invention relates to an external combustion engine for converting the displacement of a working liquid caused by the vapor volume change thereof into, and outputting it as, mechanical energy.

2. Description of the Related Art

A conventional external combustion engine is disclosed in Japanese Unexamined Patent Publication No. 2004-84523, in which a working liquid is sealed in a container and partly heated and vaporized by a heater, and the vapor of the working liquid thus vaporized is cooled and liquefied by a cooler, so that the displacement of the working liquid caused by the vapor volume change thereof is output by being converted into mechanical energy.

In this conventional external combustion engine, a heated portion of the container, in which the working liquid is vaporized, is formed of a straight tube and the heater is arranged on the outer peripheral surface of the heated portion thereby to heat and vaporize the working liquid.

SUMMARY OF THE INVENTION

In the conventional combustion engine in which the heated portion is formed of a straight tube, however, the working liquid, if changed in vapor volume, uniformly flows in the heated portion and is displaced. During the heat transfer from the heater to the working liquid before vaporization thereof, therefore, a thermal boundary layer is developed undesirably in the neighborhood of the inner wall surface of the heated portion. As a result, the problem is posed that the heat transfer rate from the heater to the working liquid is reduced.

In view of this problem, the object of this invention is to improve the heat transfer rate from the heater to the working liquid.

In order to achieve this object, according to a first aspect of the invention, there is provided an external combustion engine comprising:

a container (11) for sealing a working liquid (12) in a way adapted allow the liquid to flow therein;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the volume change of the vapor of the working liquid (12) is converted into mechanical energy and output, and wherein the heated portion (11*d*) of the container (11) for vaporizing the working liquid (12) is so formed that the direction of displacement of the working liquid (12) at the part (17, 19) of the heated portion (11*d*) far from the cooler (14) is changed with respect to the direction of displacement of the working liquid (12) at the part (16) near to the cooler (14).

With this configuration, when the direction of displacement of the working liquid (12) is changed in the heated portion (11*d*), the working liquid (12) collides with the inner wall surface of the heated portion (11*d*). Thus, the working liquid (12) is agitated and a turbulence is generated, so that the thermal boundary layer in the neighborhood of the inner wall surface of the heated portion (11*d*) can be destroyed. As a result, the heat transfer rate from the heater (13) to the working liquid (12) is improved.

Specifically, according to the invention, the heated portion (11*d*) is formed of a first path portion (16) extending toward the cooler (14) and a second path portion (17, 19) extending in the direction, across the first path portion (16), from the end of the first path portion (16) far from the cooler (14).

With this simple configuration, the direction of displacement of the working liquid (12) at the part (17, 19) of the heated portion (11*d*) far from the cooler (14) can be changed with respect to the direction of displacement of the working liquid (12) at the part (16) near to the cooler (14).

Specifically, according to the invention, the angle formed between the direction in which the first path portion (16) extends and the direction in which the second path portion (17, 19) extends is set to the range not less than 15 degrees but not more than 90 degrees.

With this configuration, it has been found that the working liquid (12) is effectively agitated, and the heat transfer rate from the heater (13) to the working liquid (12) can be effectively improved, as described in detail later.

Specifically, according to the invention, the second path portion (17, 19) extends in horizontal direction.

With this configuration, the working liquid (12) agitated by colliding with the inner wall surface of the heated portion (11*d*) can advance into the second path portion (17, 19) smoothly in spite of gravity. As a result, the advance of the agitated working liquid (12) into the second path portion (17, 19) is facilitated, thereby improving the heat transfer rate from the heater (13) to the working liquid (12).

Specifically, according to the invention, the sectional area of the second path portion (17, 19) is smaller than that of the first path portion (16). It is possible, therefore, to effectively heat the working liquid (12) far from the inner wall surface of the second path portion (17, 19) as well as the working liquid (12) in the neighborhood of the inner wall surface of the second path portion (17, 19). Thus, the heat transfer rate from the heater (13) to the working liquid (12) is improved.

Specifically, according to the invention, a plurality of the second path portions (17, 19) are formed.

Specifically, according to the invention, the second path portion (17) is formed as a tube.

Specifically, according to the invention, the second path portion (17) is formed as a hollow cylinder having the inner diameter (d2) not more than the heat penetration depth (δ).

With this configuration, the working liquid (12) far from the inner wall surface of the second path portion (17, 19) as well as the working liquid (12) in the neighborhood of the inner wall surface of the second path portion (17, 19) can be positively heated, and therefore the heat transfer rate from the heater (13) to the working liquid (12) is improved.

The heat penetration depth (δ), which is an index of the extent to which the periodic temperature change, if any, of the working liquid (12) in the second path portion (17, 19) is transmitted, is expressed by Equation (1) below.

$$\delta=\sqrt{(2\cdot\alpha/\omega)} \quad (1)$$

where α is the thermal diffusivity (JIS Z8202-4) and ω the angular frequency.

Specifically, according to the invention, the second path portion (19) is formed as a planar hollow portion.

Specifically, according to the invention, the size (c) of the cavity (20) of the second path portion (19) in the direction perpendicular to the direction in which the second path portion (19) extends is set to not more than the heat penetration depth (δ).

With this configuration, the working liquid (12) far from the inner wall surface of the second path portion (19) as well as the working liquid (12) in the neighborhood of the inner wall surface of the second path portion (19) can be positively heated, and therefore the heat transfer rate from the heater (13) to the working liquid (12) is further improved.

According to a second aspect of the invention, there is provided an external combustion engine comprising:

a container (11) for sealing a working liquid (12) in a way adapted to allow the liquid to flow therein;

a heater (13) for heating and vaporizing the working liquid (12) through the container (11); and a cooler (14) for cooling and liquefying the vapor formed by being heated by the heater (13);

wherein the periodic flow displacement of the working liquid (12) caused by the vaporization and the liquefaction of the working liquid (12) is output by being converted into mechanical energy;

wherein the inner wall surface of the heated portion (11*d*) of the container (11) for vaporizing the working liquid (12) has a stepped collision surface in which a first inner wall surface portion (24) far from the cooler (14) is projected inward of the heated portion (11*d*) more than a second inner wall surface portion (25) near to the cooler (14).

With this configuration, the vapor of the working liquid (12) is cooled and liquefied by the cooler (14), and the working liquid (12), advancing into the heated portion (11*d*) from the cooler (14), collides with the collision surface (23) of the heated portion (11*d*).

As a result, the working liquid (12) is agitated and a turbulence is formed, thereby making it possible to destroy the thermal boundary layer in the neighborhood of the inner wall surface of the heated portion (1*d*). Thus, the heat transfer rate from the heater (13) to the working liquid (12) is improved.

Specifically, according to the invention, the collision surface (23) is formed over the entire periphery of the heated portion (11*d*).

With this configuration, a greater amount of the working liquid (12) can be agitated by collision with the inner wall surface of the heated portion (11*d*), and therefore the heat transfer rate from the heater (13) to the working liquid (12) is improved.

Specifically, according to the invention, the heated portion (11*d*) may be arranged above the cooled portion (11*e*) for liquefying the vapor of the working liquid (12) in the container (11).

Specifically, according to the invention, a gas (18) always exists in the heated portion (11*d*), and therefore, a space for vaporizing the working liquid (12) heated by the heater (13) can be secured in the heated portion (11*d*).

Specifically, according to the invention, a gas sealing portion (21) for sealing the gas (18) and communicating with the heated portion (11*d*) may be formed in the container (11).

Specifically, according to the invention, a gas sealing portion (21) for sealing the gas (18) and communicating with the second path portion (17) may be formed in the container (11).

Specifically, the external combustion engine according to the invention includes a heating means (13) for heating the gas sealing portion (21) to at least the temperature of the vapor of the working liquid (12). Therefore, the vapor of the working liquid (12), which may advance into the gas sealing portion (21) at the time of heating and vaporizing the working liquid (12) by the heater (13), is prevented from being cooled and liquefied by the gas sealing portion (21).

Specifically, according to the invention, the heating means constitutes the heater (13) so that the gas sealing portion (21) can be heated to not lower than the vapor temperature of the working liquid (12) with a simple configuration.

Specifically, according to the invention, the container (11) is formed to extend from an end for outputting the mechanical energy toward the other end, and the gas sealing portion (21) is arranged nearer to the other end than the heated portion (11*d*).

Specifically, according to the invention, the air may be employed as the gas (18).

Specifically, according to the invention, the vapor of the working liquid (12) can be employed as the gas (18).

The reference numerals inserted in the parentheses following the names of each means described above and in the claims indicate the correspondence with the specific means described in the embodiments described later.

The present invention may be more fully understood from the description of preferred embodiments of the invention, as set forth below, together with the accompanying drawings.

DESCRIPTION OF THE PREFERRED EMBODIMENTS

First Embodiment

Figure 1:
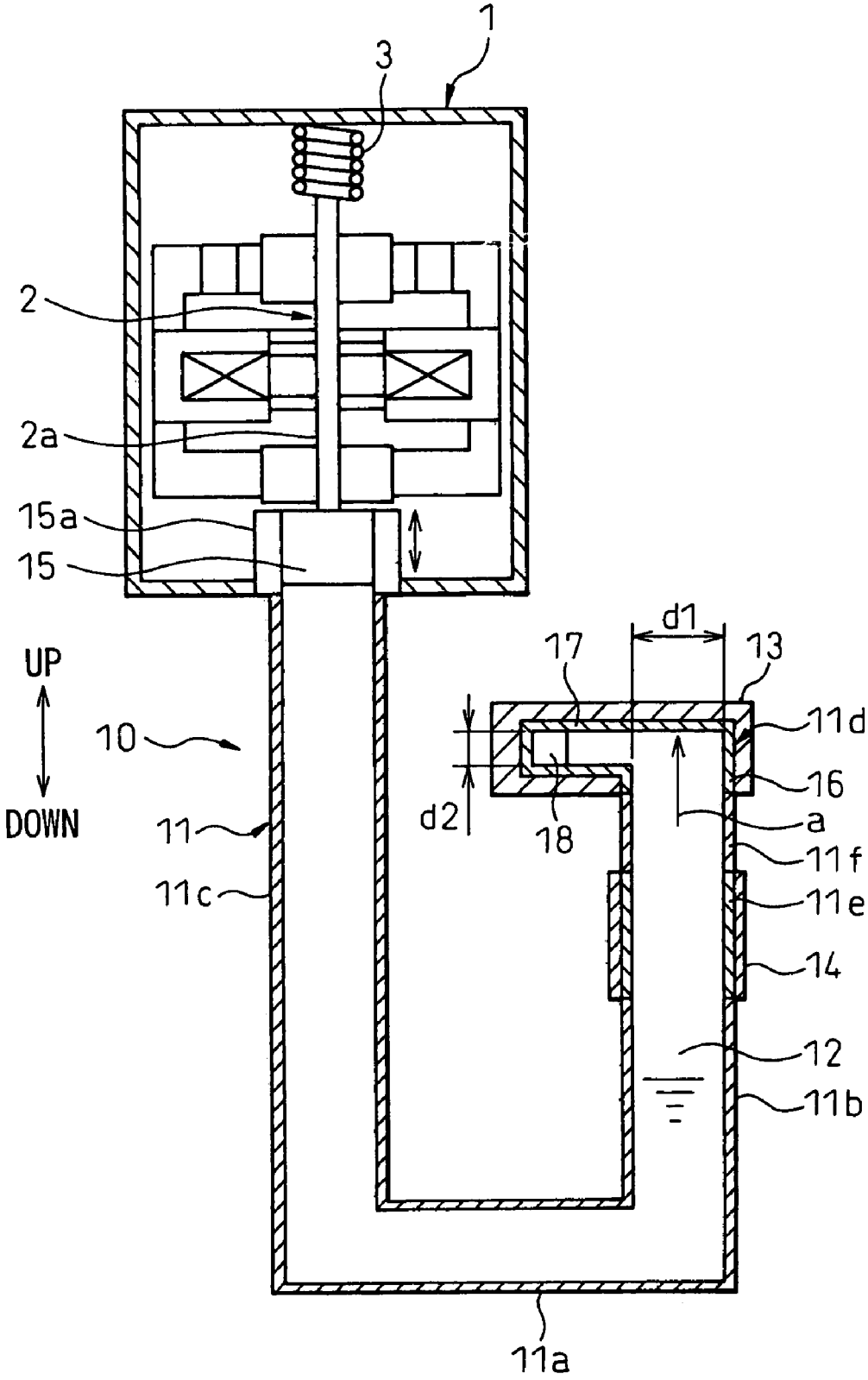
FIG. 1 is a diagram showing a general configuration of a power generating unit according to a first embodiment of the invention.
Figure 2:
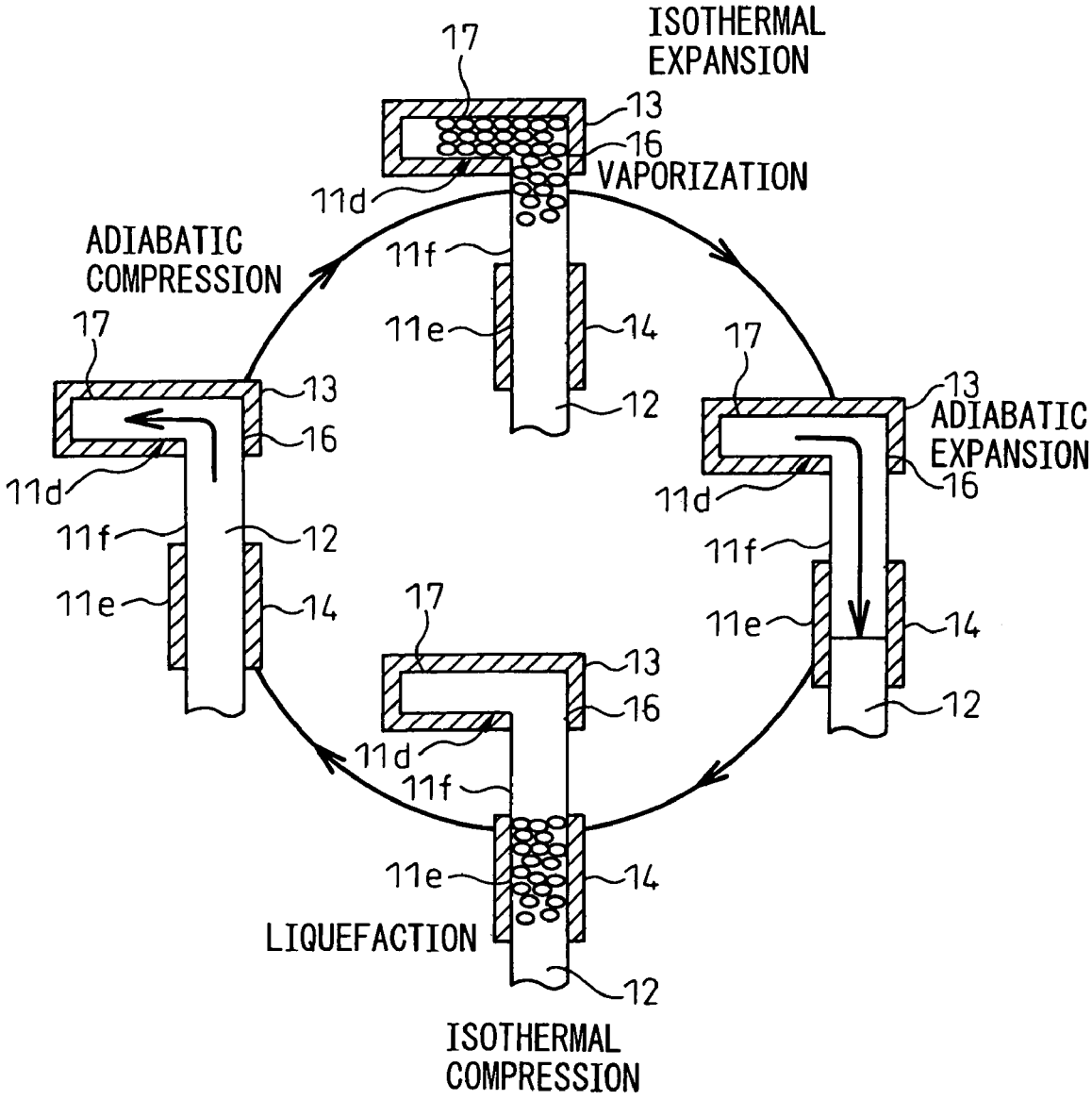
FIG. 2 is a diagram for explaining the operation characteristics of an external combustion engine according to the first embodiment.

The first embodiment of the invention is explained below with reference to FIGS. 1 and 2. FIG. 1 is a diagram showing a general configuration of a power generating unit including an external combustion engine 10 according to the invention and a power generator 1. In FIG. 1, the up arrow indicates "up" in vertical direction and the down arrow "down" in vertical direction.

As shown in FIG. 1, the external combustion engine 10 according to this embodiment, which is for driving the generator 1 to generate the electromotive force by the vibratory displacement of a movable element 2 embedded with a permanent magnet, includes a container 11 for sealing a working liquid (water in this embodiment) 12 in a way adapted to allow the liquid to flow therein, a heater 13 making up a heating means for heating the working liquid 12 in the container 11, and a cooler 14 for cooling the vapor of the working liquid 12 heated and vaporized by the heater 13.

According to this embodiment, a high-temperature gas is used as a heat source of the heater 13. Also, the cooling water is circulated in the cooler 14 according to this embodiment. Though not shown, a radiator for radiating the heat deprived of by the cooling water from the vapor of the working liquid 12 is arranged in the cooling water circulation circuit.

The container 11 is a tubular pressure vessel formed substantially in the shape of U having first and second straight portions 11*b*, 11*c* with a bent portion 11*a* at the lowest position. The first straight portion 11*b* at one horizontal end (right side on the page) following the bent portion 11*a* of the container 11 includes the heater 13 and the cooler 14 with the former located above the latter.

According to this embodiment, the heated portion 11*d* of the container 11 in contact with the heater 13 and the cooled portion 11*e* of the container 11 in contact with the cooler 14 are formed of copper or aluminum high in heat conductivity.

The intermediate portion 11*f* between the heated portion 11*d* and the cooled portion 11*e* of the container 11, on the other hand, is formed of stainless steel high in heat insulating properties. The portion of the container 11 nearer to the generator 1 than the cooled portion 11*e* is also formed of stainless steel high in heat insulating properties.

A piston 15 adapted to be displaced under the pressure of the working liquid is arranged slidably in a cylinder unit 15*a* at the upper end of the second straight portion 11*c* at the other horizontal end (left side on the page) of the container following the bent portion 11*a*.

The piston 15 is coupled to the shaft 2*a* of the movable element 2, and a spring 3 making up an elastic means for generating the elastic force to press the movable element 2 against the piston 15 is arranged on the other side of the generator 1 far from the piston 15 beyond the movable element 2.

In order to improve the heat transfer rate from the heater 13 to the working liquid 12, the heated portion 11*d* formed at the upper end of the first straight portion 11*b* is formed as a bent tube. Specifically, the heated portion 11*d* is formed of a cylindrical first path portion 16 extending in parallel to the first straight portion 11*b* near to the cooled portion 11*e* and a cylindrical second path portion 17 extending in the direction across the direction in which the first path portion 16 extends from the end (upper end in FIG. 1) of the first path portion 16 far from the cooled portion 11*e*.

According to this embodiment, the first path portion 16 extends in vertical direction, and the angle between the direction in which the first path portion 16 extends and the direction in which the second path portion 17 extends is set at 90 degrees. Thus, the second path portion 17 extends in horizontal direction.

The inner diameter d2 of the second path portion 17 is smaller than the inner diameter d1 of the first path portion 16. The sectional area of the second path portion 17, therefore, is smaller than that of the first path portion 16.

Further, the inner diameter d2 of the second path portion 17 is set to not more than the heat penetration depth δ. The heat penetration depth δ is an indicator of the extent to which the periodic temperature change, if any, of the working liquid 12 in the second path portion 17 is transmitted. Specifically, the heat penetration depth δ is the indicator for determining the radial distribution of the entropy change in the second path portion 17 from the thermal diffusivity α(m/s) and the angular frequency ω(rad/s), and expressed by Equation (1) below.

$$\delta=\sqrt{(2\cdot\alpha/\omega)} \quad (1)$$

where the thermal diffusivity α is a value obtained by dividing the heat conductivity of the working liquid 12 by the specific heat and density thereof (JIS Z8202-4).

In order to secure the internal space of the container 11 to vaporize the working liquid 12 heated by the heater 13, the gas 18 of a predetermined volume is sealed in the second path portion 17. This gas 18 may be, for example, air or a pure vapor of the working liquid 12.

The gas 18 in FIG. 1 assumes the state at the moment when the liquid level of the working liquid 12 in the first straight portion 11*b* is highest. In this state, the gas 18 exists in the deepest part (left side in FIG. 1) of the second path portion 17.

Next, the operation with the aforementioned configuration is explained with reference to FIG. 2. With the activation of the heater 13 and the cooler 14, the working liquid (water) 12 in the heated portion 11*d* is heated and vaporized by the heater 13, and the high-temperature high-pressure vapor of the working liquid 12 is accumulated in the heated portion 11*d* thereby to press down the liquid level of the working liquid 12 in the first straight portion 11*b*. Then, the working liquid 12 sealed in the container 11 is displaced from the first straight portion 11*b* to the second straight portion 11*c* and pushes up the piston 15 in the generator 1.

Also, if the liquid level of the working liquid 12 in the first straight portion 11*b* of the container 11 drops to the cooled portion 11*e* and the vapor of the working liquid 12 advances into the cooled portion 11*e*, the vapor of the working liquid 12 is cooled and liquefied by the cooler 14. Therefore, the force to push down the liquid level of the working liquid 12 in the first straight portion 11*b* is lost, and the liquid level of the working liquid 12 in the first straight portion 11*b* rises. As a result, the piston 15 in the power generator 1 which has been pushed up by the expansion of the vapor of the working liquid 12 falls.

This operation is repeated until the heater 13 and the cooler 14 stop the operation. In the process, the working liquid 12 in the container 11 is periodically displaced (by what is called the self-excited vibration) thereby to move the movable element 2 of the power generator 1 vertically.

According to this embodiment, the heated portion 11*d* is formed as a bent tube. In the heated portion 11*d*, therefore, the direction of displacement of the working liquid 12 is changed along the bend of the heated portion 11*d*.

More specifically, assume that the vapor of the working liquid 12 is cooled and liquefied by the cooler 14 and the liquid level in the first straight portion 11*b* rises. Then, the working liquid 12, after being displaced upward and advancing into the first path portion 16 of the heated portion 11*d*, changes the direction of displacement toward the second path portion 17 (left side in FIG. 1) and enters the second path portion 17. In the process, as indicated by arrow a in FIG. 1, the working liquid 12 collides with the inner wall surface of the heated portion 11*d*.

The working liquid 12, colliding with the inner wall surface of the heated portion 11*d* as described above, is agitated and generates turbulence. As a result, the thermal boundary layer is destroyed in the neighborhood of the inner wall surface of the heated portion 11*d* collided by the working liquid 12, and therefore the heat transfer rate from the heater 13 to the working liquid 12 is improved.

In the case where the angle of bend of a fluid path in which a fluid flows is set in the range of not less than 15 degrees but not more than 90 degrees, the fluid is effectively agitated and the heat transfer rate is improved, as reported in K. P. Perry, "Heat Transfer By Convection from a Hot Gas Jet to a Plane Surface", Proceedings of Institution of Mechanical Engineers, Vol. 168 (1954, Great Britain), pp. 775 to 780.

Thus, in the case where the angle of bend of the heated portion 11*d* forming the flow path of the working liquid 12, i.e. the angle between the direction in which the first path portion 16 extends and the direction in which the second path portion 17 extends is set to between 15 degrees and 90 degrees inclusive, then the heat transfer rate from the heater 13 to the working liquid 12 can be effectively improved.

Also, according to this embodiment, the second path portion 17 extends in horizontal direction, and therefore, the agitated working liquid 12 can advance into the second path portion 17 smoothly in spite of gravity. As a result, the working liquid, while kept agitated, can easily enter the second path portion 17. Thus, the heat transfer rate from the heater 13 to the working liquid 12 is more effectively improved.

Further, according to this embodiment, the inner diameter d2 of the second path portion 17 is smaller than the inner diameter d1 of the first path portion 16, and the sectional area of the second path portion 17 is smaller than that of the first path portion 16. Therefore, the working liquid 12 along the center (the part far from the inner wall surface) as well as in the neighborhood of the inner wall surface the second path portion 17 can be effectively heated. As a result, the heat transfer rate from the heater 13 to the working liquid 12 can be more effectively improved.

Furthermore, as the inner diameter d2 of the second path portion 17 is not more than the heat penetration depth δ, the working liquid 12 along the center as well as in the neighborhood of the inner wall surface of the second path portion 17 can be positively heated. In the second path portion 17, therefore, the heat transfer rate from the heater 13 to the working liquid 12 can be more effectively improved.

As described above, according to this embodiment, the heat transfer rate from the heater 13 to the working liquid 12 is improved with a simple configuration in which the heated portion 11*d* is formed as a bent tube.

Second Embodiment

Figure 3A:
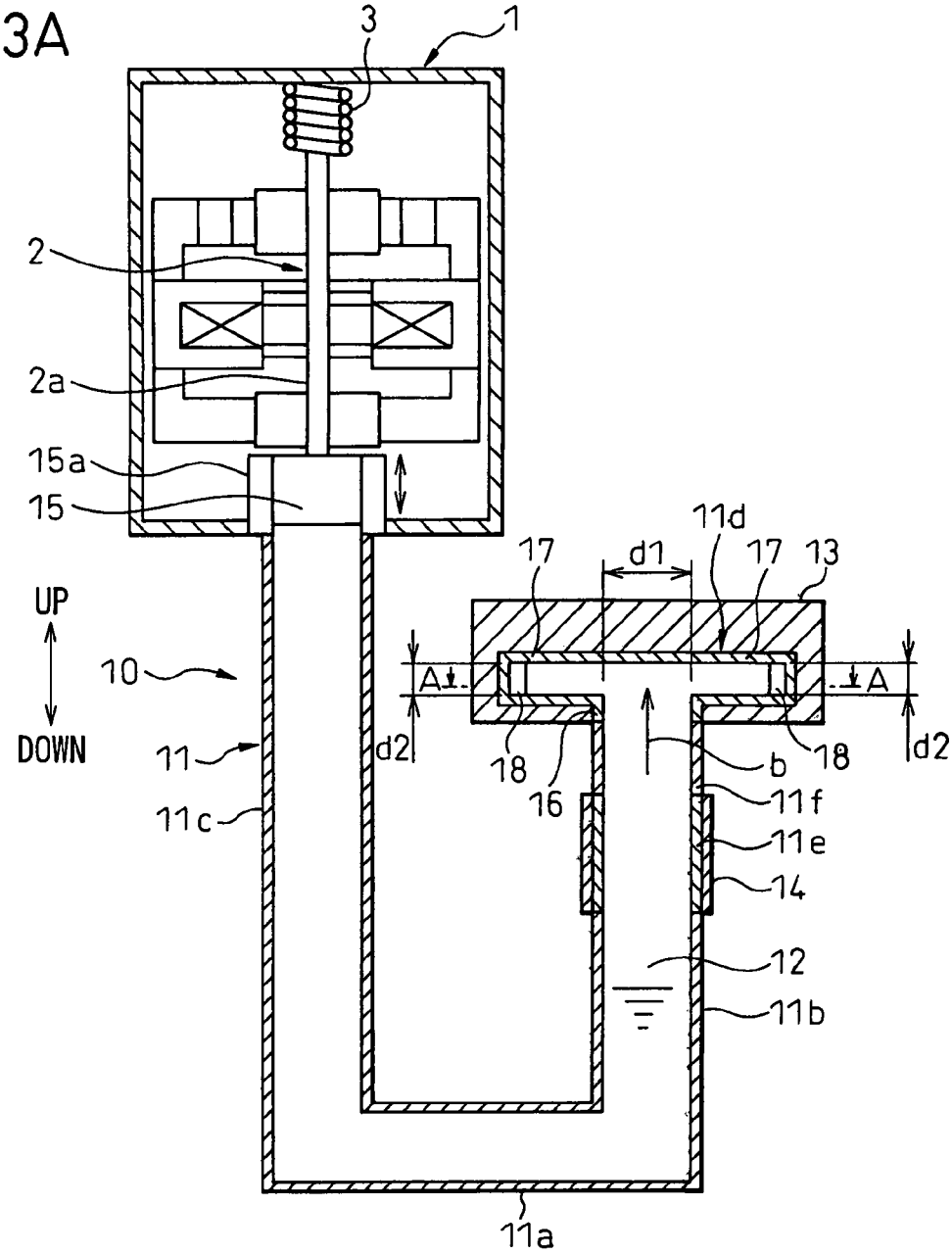
FIG. 3A is a diagram showing a general configuration of the power generating unit according to a second embodiment of the invention, and FIG. 3B a sectional view taken in line A-A in FIG. 3A.
Figure 3B:
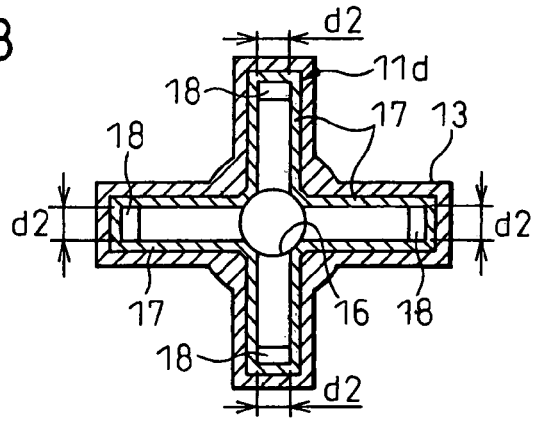

According to the second embodiment, unlike in the first embodiment with the heated portion 11*d* formed as a bent tube, the heated portion 11*d* has a plurality of tubular branches on the side thereof far from the cooled portion 11*e* as shown in FIGS. 3A, 3B.

FIG. 3A is a diagram showing a general configuration of a power generating unit according to this embodiment, and FIG. 3B a sectional view taken in line A-A in FIG. 3A.

According to this embodiment, unlike in the first embodiment, a plurality of cylindrical second path portions 17 are formed. More specifically, four second path portions 17 extend radially in horizontal direction from the upper end of the first path portion 16.

The inner diameter d2 of the four second path portions 17, as in the first embodiment, is set to a value smaller than the inner diameter d1 of the first path portion 16 and not larger than the heat penetration depth δ.

According to this embodiment, in the case where the vapor of the working liquid 12 is cooled and liquefied by the cooler 14 and the liquid level in the first straight portion 11*b* rises, then the working liquid 12 collides with the inner wall surface of the heated portion 11*d* as shown by arrow b in FIG. 3A.

As a result, the working liquid 12 in the heated portion 11*d* is agitated and a turbulence is generated. Thus, the heat transfer rate from the heater 13 to the working liquid 12 is improved in the neighborhood of the inner wall surface of the heated portion 11*d* collided by the working liquid 12.

The working liquid 12 that has collided with the inner wall surface of the heated portion 11*d* advances into the four second path portions 17 in agitated state, and therefore the heat transfer rate from the heater 13 to the working liquid 12 is improved in the four second path portions 17.

As a result, the effects similar to those of the first embodiment are achieved.

Third Embodiment

Figure 4A:
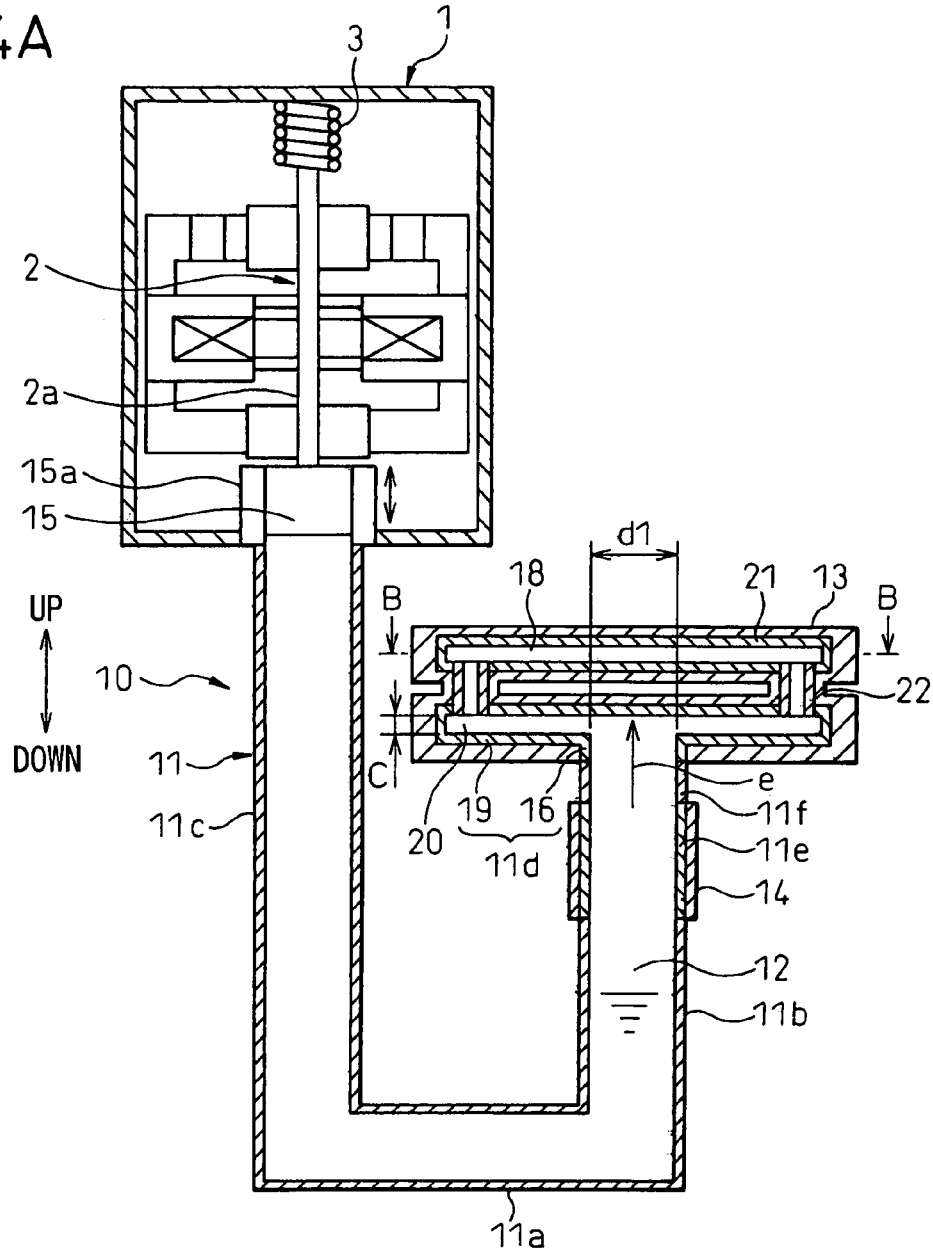
FIG. 4A is a diagram showing a general configuration of the power generating unit according to a third embodiment of the invention, and FIG. 4B a sectional view taken in line B-B in FIG. 4A.
Figure 4B:
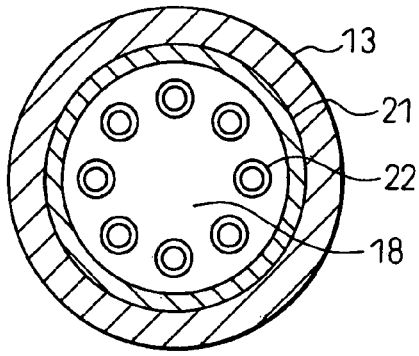

According to this third embodiment, unlike in the first and second embodiments in which the second path portion 17 is formed as a cylinder, the second path portion 19 is formed as a flat hollow portion as shown in FIGS. 4A, 4B.

FIG. 4A is a diagram showing a general configuration of the power generating unit according to this embodiment, and FIG. 4B a sectional view taken in line B-B in FIG. 4A. The flat hollow second path portion 19, in the shape of a circle having the center on the first path portion 16, extends horizontally. Therefore, the direction in which the first path portion 16 extends and the direction in which the second path portion 19 extends form an angle of 90 degrees with each other.

The cavity 20 of the second path portion 19 also assumes a circle extending in horizontal direction. The vertical size c of the cavity 20 is smaller than the inner diameter d1 of the first path portion 16 and not larger than the heat penetration depth δ.

A flat hollow gas sealing portion 21 sealed with the gas 18 is formed above the second path portion 19. The gas sealing portion 21 is in the shape of a circle concentric with the second path portion 19, and communicates with the second path portion 19 through a plurality of communication pipes 22 arranged along the circumference thereof.

Also, the gas sealing portion 21 is heated to at least the temperature of the second path portion 19 by the heater 13. According to this embodiment, the gas sealing portion 21 is formed of copper or aluminum high in heat conductivity.

According to this embodiment, the vapor of the working liquid 12 is cooled and liquefied by the cooler 14, and with the rise of the liquid level in the first straight portion 11*b*, the working liquid 12 comes to collide with the inner wall surface of the heated portion 11*d* as shown by arrow e in FIG. 4A.

As a result, the working liquid 12 in the heated portion 11*d* is agitated and a turbulence generated. The thermal boundary layer can thus be destroyed in the neighborhood of the inner wall surface of the heated portion 11*d* with which the working liquid 12 collides. As a result, the heat transfer rate from the heater 13 to the working liquid 12 is improved.

The working liquid 12 that has collided with the inner wall surface of the heated portion 11*d*, while kept agitated, advances into the second path portion 19. Therefore, the heat transfer rate from the heater 13 to the working liquid 12 is effectively improved.

Also, according to this embodiment, the vertical size c of the second path portion 19 is smaller than the inner diameter d1 of the first path portion 16. Therefore, the working liquid 12 far from the inner wall surface of the second path portion 19 as well as in the neighborhood of the inner wall surface of the second path portion 19 can be effectively heated. As a result, the heat transfer rate from the heater 13 to the working liquid 12 is effectively improved in the second path portion 19.

Further, in view of the fact that the vertical size c of the second path portion 19 is not larger than the heat penetration depth δ, the working liquid 12 far from the inner wall surface of the second path portion 19 as well as in the neighborhood of the inner wall surface of the second path portion 19 can be positively heated. As a result, the heat transfer rate from the heater 13 to the working liquid 12 is even more effectively improved in the second path portion 19.

Also, according to this embodiment, the gas sealing portion 21 is heated by the heater 13 to at least the temperature of the second path portion 19, i.e. at least the temperature of the vapor of the working liquid 12. Therefore, the vapor of the working liquid 12, heated and vaporized by the heater 13 and advancing into the gas sealing portion 21, is prevented from being cooled and liquefied by the gas sealing portion 21.

Fourth Embodiment

In the embodiments described above, the working liquid 12 is caused to collide with the inner wall surface of the heated portion 11*d* by changing the direction in which the working liquid 12 is displaced in the heated portion 11*d*. According to the fourth embodiment, on the other hand, as shown in FIG. 5, a collision surface 23 is formed as a stepped inner wall surface of the heated portion 11*d*, with which the working liquid 12 is caused to collide.

Figure 5:
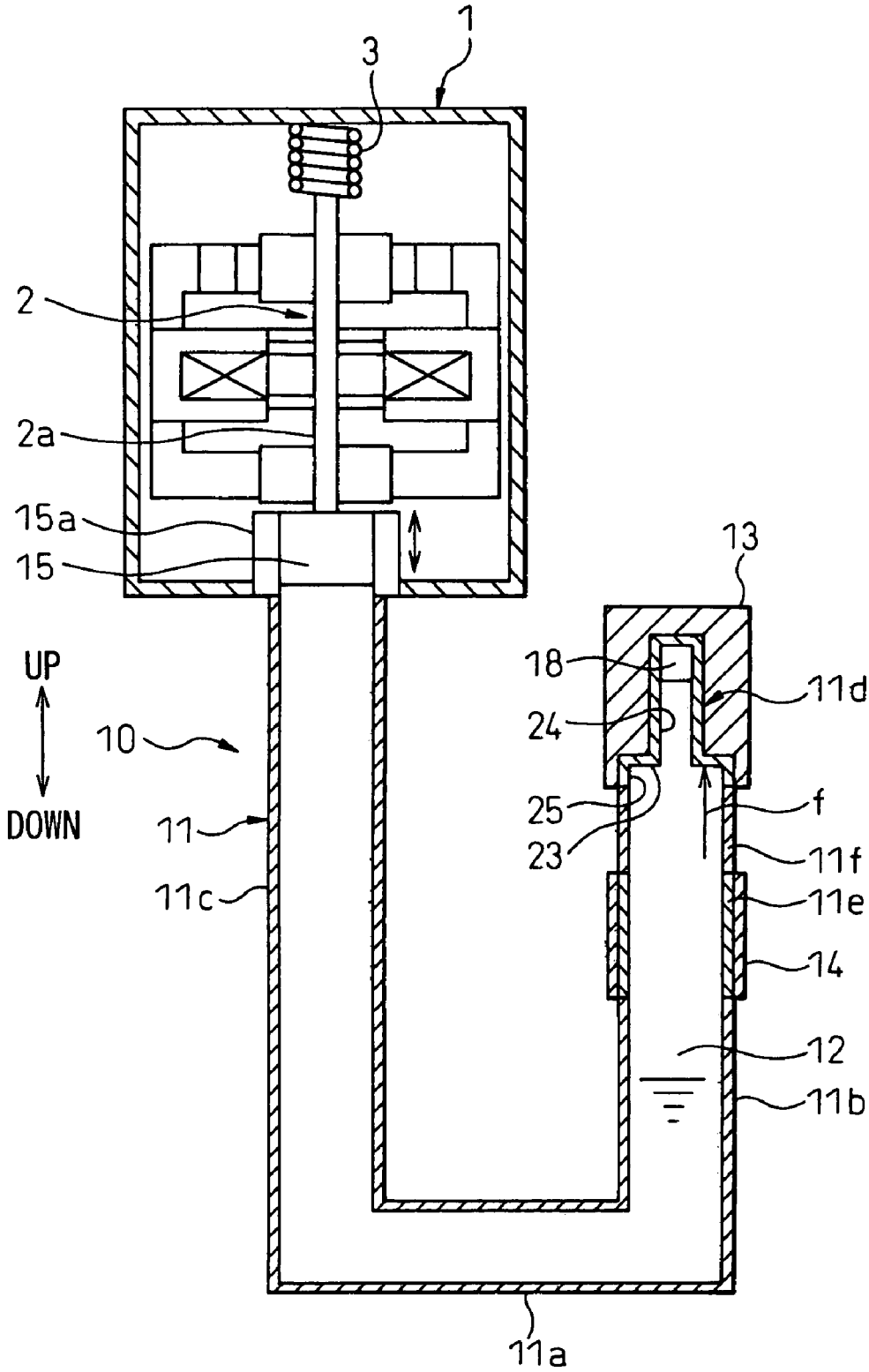
FIG. 5 is a diagram showing a general configuration of the power generating unit according to a fourth embodiment of the invention.

FIG. 5 is a diagram showing a general configuration of the power generating unit according to this embodiment. In this embodiment, the heated portion 11*d* is formed of a cylinder as a whole extending in parallel to the first straight portion 11*b* without being bent.

As shown in FIG. 5, the stepped collision surface 23 is formed on the inner wall surface of the heated portion 11*d*. Specifically, the first inner wall surface portion 24 of the inner wall surface of the heated portion 11*d*, which is far from the cooled portion 11*e*, is projected inward of the heated portion 11*a* as compared with the second inner wall surface portion 25 near to the cooled portion 11*e*.

An annular collision surface 23 facing the cooled portion 11*e* is formed between the first inner wall surface portion 24 and the second inner wall surface portion 25. Also, the heated portion 11*d* is sealed with the gas 18 of a predetermined volume.

According to this embodiment, assume that the vapor of the working liquid 12 is cooled and liquefied by the cooler 14, and the liquid level in the first straight portion 11*b* rises. Then, as shown by arrow f in FIG. 5, the working liquid 12 advances into the heated portion 11*d*, and collides with the collision surface 23 of the heated portion 11*d*.

Thus, the working liquid 12 in the heated portion 11*d* is agitated and a turbulence is generated. Thus, the thermal boundary layer in the neighborhood of the collision surface 23 can be destroyed. As a result, the heat transfer rate from the heater 13 to the working liquid 12 is improved.

The gas 18 may be, for example, air or a pure vapor of the working liquid 12, as is in the embodiments described above.

OTHER EMBODIMENTS (1) The second path portion 17, though formed to extend in horizontal direction in the first and second embodiments described above, may alternatively be formed to extend in other than the horizontal direction.

(2) The angle between the direction in which the first path portion 16 extends and the direction in which the second path portion 17 extends, though set to 90 degrees in the first and second embodiments described above, may alternatively be set in the range between 15 degrees and 90 degrees inclusive.

(3) The first path portion 16 and the second path portion 17, though formed as a cylinder in the first and second embodiments described above, may alternatively be formed as a rectangular tube, for example, other than a cylinder.

(4) The second path portion 19, though formed to extend in horizontal direction in the third embodiment described above, may alternatively be formed in other than the horizontal direction.

(5) The angle between the direction in which the first path portion 16 extends and the direction in which the second path portion 17 extends, though set to 90 degrees in the third embodiment described above, may alternatively be set in the range between 15 and 90 degrees inclusive.

(6) Unlike in the third embodiment described above in which only one second path portion 19 is formed, a plurality of the second path portions 19 branching from the first path portion 16 may be formed.

(7) The heated portion 11*d* as a whole, though formed as a circular cylinder in the fourth embodiment described above, may alternatively be formed as other than a circular cylinder such as a rectangular cylinder.

(8) The heated portion 11*d*, though formed as a straight tube in the fourth embodiment described above, may alternatively be formed as a bent tube.

(9) The gas sealing portion 21, though communicating with the second path portion 19 in the third embodiment described above, may alternatively communicate with the first path portion 16.

(10) The gas sealing portion 21, though arranged at a position nearer to the end of the container 11 than the heated portion 11*d* in the third embodiment, may alternatively be arranged between the heated portion 11*d* and the power generator 1.

(11) The gas 18, though sealed in the heated portion 11*d* in the first, second and fourth embodiments described above, may alternatively be sealed in the gas sealing unit communicating with the heated portion 11*d*.

(12) The heated portion 11*d*, though arranged above the cooled portion 11*e* in the embodiments described above, may alternatively be arranged under the cooled portion 11*e*.

(13) The heater 13 and the heated portion 11*d*, though formed as separate members in the embodiments described above, may alternatively be formed integrally with each other.

(14) Although a high-temperature gas is used as a heat source of the heater 13, an electric heater may be used as the heater 13.

(15) Although an application of the invention to the drive source of the power generating unit is explained above, the external combustion engine according to the invention may also be used as a drive source of other than a power generating unit.

While the invention has been described by reference to specific embodiments chosen for purposes of illustration, it should be apparent that numerous modifications could be made thereto by those skilled in the art without departing from the basic concept and scope of the invention.

The invention claimed is:

1. An external combustion engine comprising:

a container for sealing a working liquid in a way adapted to allow the liquid to flow therein;

a heater for heating and vaporizing the working liquid in a heated portion of the container, the heater being in direct contact with the entire heated portion of the container; and a cooler for cooling and liquefying the vapor of the working liquid heated and vaporized by the heater in a cooled portion of the container;

wherein displacement of the working liquid caused by a volume change of the vapor of the working liquid is converted into mechanical energy and output, and wherein the heated portion of the container is so formed that a first direction of displacement of the working liquid in the heated portion proximate the cooler is is different than a second direction of displacement of the working liquid in the heated portion distal from the cooler.

2. The external combustion engine according to claim 1, wherein the heated portion includes a first path portion extending the first direction and a second path portion extending in the second direction, the second oath portion extending across the first path portion, from an end of the first path portion distal from the cooler.

3. The external combustion engine according to claim 2, wherein an angle formed between the first direction in which the first path portion extends and the second direction in which the second path portion extends is not less than 15 degrees but not more than 90 degrees.

4. The external combustion engine according to claim 2, wherein the second path portion extends in a horizontal direction.

5. The external combustion engine according to claim 2, wherein a sectional area of the second path portion is smaller than a sectional area of the first path portion.

6. The plurality external combustion engine according to claim wherein a of second path portions are formed.

7. The external combustion engine according to claim 2, wherein the second path portion is formed as a tubular member.

8. The external combustion engine according to claim 7, wherein the second path portion is formed as a hollow cylinder having an inner diameter (d2) not more than a heat penetration depth (δ).

9. The external combustion engine according to claim 2, wherein the second path portion is formed as a flat hollow portion.

10. The external combustion engine according to claim 9, wherein a size (c) of a cavity of the second path portion in a direction perpendicular to the second direction is not greater than a heat penetration depth (δ).

11. An external combustion engine comprising:

a container for sealing a working liquid in a way adapted to allow the liquid to flow therein;

a heater for heating and vaporizing the working liquid in a heated portion of the container, the heater being in direct contact with the entire heated portion of the container; and a cooler for cooling and liquefying the vapor heated and vaporized by the heater;

wherein periodic flow displacement of the working liquid caused by the vaporization and the liquefaction of the working liquid is output by being converted into mechanical energy; and wherein an inner wall surface of the heated portion of the container has a stepped collision surface which is projected inward from a second inner wall surface portion proximate the cooler.

12. The external combustion engine according to claim 11, wherein the collision surface is formed over the entire periphery of the heated portion.

13. The external combustion engine according to claim 1, wherein the heated portion is arranged above the cooled portion of the container for liquefying the vapor of the working liquid.

14. The external combustion engine according to claim 1, wherein a gas always exists in the heated portion.

15. The external combustion engine according to claim 1, wherein a gas sealing portion for sealing gas and communicating with the heated portion is formed in the container.

16. The external combustion engine according to claim 2, wherein a gas sealing portion for sealing gas and communicating with the second path portion is formed in the container.

17. The external combustion engine according to claim 15, comprising heating means for heating the gas sealing portion to at least the temperature of the vapor of the working liquid.

18. The external combustion engine according to claim 17, wherein the heating means is the heater.

19. The external combustion engine according to claim 15, wherein the container has a first end and a second end, and wherein the gas sealing portion is arranged nearer to the second end than the heated portion.

20. The external combustion engine according to claim 14, wherein the gas is the air.

21. The external combustion engine according to claim 14, wherein the gas is the vapor of the working liquid.

22. The external combustion engine according to claim 19, wherein the gas is the air.

23. The external combustion engine according to claim 19, wherein the gas is the vapor of the working liquid.

* * * * *